US011658427B2

(12) United States Patent
Schlegel et al.

(10) Patent No.: US 11,658,427 B2
(45) Date of Patent: May 23, 2023

(54) CONNECTION DEVICE FOR ELECTRICAL CONDUCTORS, AND SPRING ELEMENT FOR A CONNECTION DEVICE

(71) Applicant: HARTING ELECTRIC GMBH & CO. KG, Espelkamp (DE)

(72) Inventors: Bernard Schlegel, Rahden (DE); Heiko Herbrechtsmeier, Buende (DE); Irina Loetkemann, Espelkamp (DE)

(73) Assignee: HARTING ELECTRIC GMBH & CO. KG

( * ) Notice: Subject to any disclaimer, the term of this patent is extended or adjusted under 35 U.S.C. 154(b) by 108 days.

(21) Appl. No.: 17/433,980

(22) PCT Filed: Feb. 19, 2020

(86) PCT No.: PCT/DE2020/100118
§ 371 (c)(1),
(2) Date: Aug. 25, 2021

(87) PCT Pub. No.: WO2020/173524
PCT Pub. Date: Sep. 3, 2020

(65) Prior Publication Data

US 2022/0140501 A1 May 5, 2022

(30) Foreign Application Priority Data

Feb. 25, 2019 (DE) ..... 10 2019 104 704.8

(51) Int. Cl.
*H01R 4/48* (2006.01)

(52) U.S. Cl.
CPC ..... *H01R 4/4827* (2013.01); *H01R 4/4836* (2013.01)

(58) Field of Classification Search
None
See application file for complete search history.

(56) References Cited

U.S. PATENT DOCUMENTS

| | | | | |
|---|---|---|---|---|
| 8,632,355 | B2 | 1/2014 | Hartmann | H01R 4/24 |
| 9,496,652 | B2 | 11/2016 | Bertsch | H01R 13/652 |
| 9,705,212 | B1 * | 7/2017 | Wu | H01R 9/26 |

(Continued)

FOREIGN PATENT DOCUMENTS

| | | | |
|---|---|---|---|
| DE | 10 2011 011 080 | 8/2012 | H01R 4/48 |
| DE | 10 2012 016 725 | 2/2014 | H01R 13/648 |

(Continued)

OTHER PUBLICATIONS

German Search Report issued in German Patent Appln. Serial No. 10 2019 104 704.8, dated Jan. 21, 2020, with machine English translation, 16 pages.

(Continued)

*Primary Examiner* — Ross N Gushi
(74) *Attorney, Agent, or Firm* — Hayes Soloway P.C.

(57) ABSTRACT

A connection device includes a bearing device for at least one spring element formed on a busbar of the connecting contact; a spring element configured to move from a first tension state in which a contact end of the spring element bears against the busbar, a second tension state in which the connection for the conductor to the busbar is closed, and a third tension state in which the contact connection for the conductor to the busbar is opened.

16 Claims, 7 Drawing Sheets

(56) References Cited

U.S. PATENT DOCUMENTS

| | | | | |
|---|---|---|---|---|
| 10,581,182 | B2 | 3/2020 | Gonzalez et al. | H01R 4/28 |
| 10,855,002 | B2 | 12/2020 | Loetkemann et al. | |
| 2012/0208393 | A1 | 8/2012 | Hartmann | 439/370 |

FOREIGN PATENT DOCUMENTS

| | | | |
|---|---|---|---|
| DE | 10 2012 110 895 | 5/2014 | H01R 4/48 |
| DE | 10 2015 104 625 | 9/2016 | H01R 4/48 |
| DE | 10 2016 101 713 | 7/2017 | H01R 4/48 |
| DE | 10 2016 120 002 | 4/2018 | H01R 13/648 |
| EP | 3 139 444 | 3/2017 | H01R 4/48 |
| GB | 2525482 | 10/2015 | H01R 13/58 |
| JP | 2004-319196 | 11/2004 | H01R 13/652 |
| WO | WO 2018/019329 | 2/2018 | H01R 4/48 |

OTHER PUBLICATIONS

International Search Report and Written Opinion issued in PCT/DE2020/100118, dated May 25, 2020, with English translation, 18 pages.

International Preliminary Report on Patentability issued in PCT/DE2020/100118, dated Aug. 25, 2021, 7 pages.

* cited by examiner

CONNECTION DEVICE FOR ELECTRICAL CONDUCTORS, AND SPRING ELEMENT FOR A CONNECTION DEVICE

BACKGROUND OF THE INVENTION

The invention relates to a connection device for electrical conductors for connection to an electrical connecting contact, and in particular for protective conductors for connection to a grounding element, in particular of a plug connector, in each case. In this case, the invention moreover relates in particular to a spring element suitable for an above connection device.

In such connection devices, to connect the electrical lines of the conductors to electrical connecting contacts, spring contact elements which are connected to the electrical connecting contacts are provided in most cases. Depending on the design, different types of spring contact elements are provided, which serve for the contacting of the lines or conductors. The spring contact elements are expediently formed such that the connection to the lines or the conductors is releasable again.

In the event of a short-circuit of a live conductor to a conductive, touchable part, e.g. a housing, grounding elements of plug connectors which are connected to protective conductors serve to maintain this touchable part at ground potential and to trip a fuse, in particular to thereby prevent a current flow to ground through the (human) body.

An added requirement of plug connectors is that an electrical connection between the grounding elements must preferably be created when mating the plug connector with its mating connector.

A screw connection is provided in most cases as a connection device for a protective conductor on a grounding element, whereby the protective conductor must be fastened on the grounding element with the aid of a screwdriver.

DESCRIPTION OF THE PRIOR ART

Multiple connection devices for electrical conductors, in particular stranded conductors, are known in the prior art.

WO 2018/019329 A1 gives an overview of solutions known from the prior art for connection devices, equipped with spring elements, for electrical conductors and moreover proposes a connection device whereby a conductor inserted into an insulating body is fixed on an electrical connecting contact by actuating an actuator.

In the case of this prior art, disadvantages can arise due to the size of the corresponding construction and due to limitations in terms of user-friendliness. Its suitability may furthermore be limited to conductors having predetermined conductor cross-sections.

DE 10 2012 016 725 A1 discloses a connection device, provided by means of a screw connection, for a grounding element of a plug connector, wherein a protective conductor is fastened on the grounding element with the aid of a screwdriver. In this case, to connect the protective conductor, a screw has to be screwed into the grounding element or unscrewed. Vibrations can cause this screw to come loose over time, which results in the protective conductor losing its function.

In the case of the screw connection, there are moreover numerous opportunities for the protective conductor to be connected incorrectly since attention needs to paid to the tightening torque of the screw. With too low a tightening torque, the connection between the grounding element and the protective conductor can come loose and interrupt the electrical connection. With too high a tightening torque, the protective conductor can become damaged, which results in the risk of the protective conductor breaking. Moreover, the protective conductor can also be fastened on the wrong side of the screw such that it is pressed outwards in an undesired manner.

Furthermore, as is the case when fastening a protective conductor connected to the grounding element, this protective conductor can also only be released by means of a screwdriver, which, if necessary, is disadvantageously time-consuming.

The German Patent and Trademark Office has searched the following prior art in the priority application relating to the present application: WO 2018/019 329 A1, DE 10 2012 016 725 A1, DE 10 2015 104 625 A1, JP 2004-319 196 A, EP 3 139 444 A1, DE 10 2012 110 895 A1, DE 10 2016 120 002 A1, DE 10 2016 101 713 A1 and DE 10 2011 011 080 A1.

SUMMARY OF THE INVENTION

The object of the invention consists in indicating a fail-safe and, with this, space-saving and moreover easy-to-handle connection device for electrical conductors for connection to an electrical connecting contact, and in particular for connection to a grounding element, in particular of a plug connector, in each case. The connection device should moreover be suitable for multiple applications, wherein a further object consists in indicating a suitable spring element for an above connection device.

The present invention relates in particular to a connection device for providing an electrical contact between at least one electrical conductor and a busbar of an electrical connecting contact.

A bearing device for at least one spring element is provided on the busbar of the connecting contact, which spring element is suitably formed and arranged in an actuable manner on the bearing device in such a way that the spring element can be brought from a predetermined first tension state to a predetermined second and third tension state.

In this case, the first tension state is suitably selected in a predetermined manner in such a way that a contact end of the spring element abuts against the busbar under a predetermined pre-tension.

In this case, the second tension state of the spring element is suitably selected in a predetermined manner in such a way that the conductor is fixed on the busbar, wherein, by means of the contact end of the spring element, a contact connection for the conductor to the busbar is closed and the conductor is clamped against the busbar with a predetermined spring force.

In this case, the third tension state of the spring element is suitably selected in a predetermined manner in such a way that the contact connection for the conductor to the busbar is opened, wherein the connection device in the third tension state is ready for inserting the conductor.

The spring element is particularly advantageously formed and arranged on the bearing device in such a way that the spring element has a suitable spring constant and a suitable, desirably long spring travel such that an inventive connection device is provided, whereof the contact connection is advantageously suitable for multiple conductors having different conductor cross-sections and therefore for different applications.

In this case, the spring element can be suitably formed and arranged in such a way that the connection device is suitable for conductor cross-sections of 0.15 $mm^2$ to 4 $mm^2$, wherein the conductor ends provided for contacting the busbar can have cable end sleeves. In this case, the spring element particularly advantageously has a suitable long spring travel so that its spring force acting on the conductor likewise increases with the increasing conductor cross-section.

In the case of an inventive connection device having an above-described, suitably formed and arranged spring element, the spring element can be advantageously brought from the first tension state to the second tension state by a conductor having predetermined properties and, in particular, a predetermined stability by inserting the conductor into the connection device. By means of this particularly advantageous push-in technique, the conductor can be contacted particularly easily by the busbar of the connecting contact, and fixed on the busbar, without the aid of a tool.

To enable the insertion of a conductor which does not have the above stability, suitable means for actuating the spring element can be provided on the spring element, which are formed and arranged in such a way that the spring element can be brought from the first tension state to the second tension state and/or from the first and/or second tension state to the third tension state and/or from the third tension state to the first and/or second tension state.

A spring element which is particularly suitable for an inventive connection device and has the above-described properties can be particularly advantageously provided by means of a meander-shaped and preferably S-shaped spring, which has a first and second bend bent in opposite directions to one another.

The present invention in particular moreover relates accordingly to such a spring element having an above advantageously meander-shaped and preferably S-shaped spring, which has a first and second bend bent in opposite directions to one another.

A suitable, advantageously compactly formed first and second bearing portion, in particular of the S-shaped spring element, can be provided by means of the first and second bend.

An elongated clamping limb can be suitably formed on the second bearing portion of the S-shaped spring element, which clamping limb has a first freely projecting end for the contact connection of the conductor to the busbar and for fixing the conductor on the busbar. In this case, the freely projecting end forms the contact end of the spring element mentioned at the outset.

In this case, to enable an above desirably long spring travel, the elongated clamping limb projects over the first and second bearing portion of the spring element, wherein the clamping limb is arranged between the first and second bearing portion and the busbar. In this case, the clamping limb is arranged adjacent to the first and second bearing portion in the above third tension state of the spring element, whilst it is comparatively spaced from the first and second bearing portion in the first tension state.

A particularly advantageous spring element having the above-described spring properties and a suitable spring travel can be provided by means of an above meander-shaped and preferably S-shaped spring element. A spring element formed in this way is moreover formed particularly compactly such that the option is advantageously created of also connecting conductors of different conductor types and with different conductor cross-sections in the tightest of spaces without the aid of a tool.

The first freely projecting contact end provided on the clamping limb can be suitably bent in the direction of the busbar on the clamping limb such that an advantageous locking contour for the conductor is provided. A conductor fixed on the busbar is thus protected against being inadvertently pulled out.

To provide a suitable bearing device for the spring element, a first and second opposing limb can be advantageously angled on the busbar of the connecting contact such that a first and second bearing portion are formed on the connecting contact by means of the first and second limb. As a result of this measure, the option is easily created of providing a first and second bearing pin for the first and second bearing portion of the spring element on the first and second bearing portion of the connecting contact.

An advantageously compact, space-saving bearing device for the spring element is provided on the connecting contact by means of the first and second bearing portion suitably provided on the busbar of the connecting contact and the first and second bearing pin. In this case, the spring element, which, despite its desirably long spring travel, still likewise has a desirably compact construction, can be advantageously provided on the bearing device in such a way that the first and second bearing pin are arranged in the bend of the first and second bearing portion of the spring element, which bends are formed in opposite directions to one another, wherein the first and second bend at least partially embrace the first and second bearing pin in each case.

In this case, the bend of the first bearing portion of the spring element can be arranged in the opposite direction to the busbar of the connecting contact and the bend of the second bearing portion can be arranged such that it faces the busbar. In this case, in its above-described first pre-tensioned tension state of the spring element, the elongated clamping limb extends between the first and second bearing portion on its one side and the busbar on its other side such that it is inclined at an acute angle to the busbar, wherein its first freely projecting, bent contact end abuts against the busbar.

According to an embodiment of the invention, a second freely projecting end, which has an opening for inserting a tool for actuating the spring element, can be formed on the clamping limb in the contrary direction to the busbar as an above-mentioned means for actuating the spring element in order to transfer it to the first, second and third tension state.

In this case, the second freely projecting end can suitably protrude a predetermined amount with its opening beyond the first and second bend of the first and second bearing portion of a preferably S-shaped spring element in the contrary direction to the busbar.

To protect, in particular, the spring element and a conductor fixed on the busbar of the connecting contact by means of a connection device of the above embodiment of the invention, a housing half shell can be provided for accommodating, in particular, the spring element and the contact connection.

In this case, a suitable housing half shell can advantageously have an inner contour, which interlocks with the connecting contact and/or the bearing pins and/or the spring element, and an insertion aid for inserting the conductor. To insert a tool into the opening of the second freely projecting end of the clamping rail of the spring element, suitable apertures can be provided in the housing half shell such that the second freely projecting end is accessible with its opening from outside the housing half shell.

According to an embodiment of the invention, as an above-mentioned means for actuating the spring element in order to transfer it to its first, second and, in particular, third tension state, an actuating element having a lever arm, two brackets and two opposing eccentric shafts can be provided as the actuating element, wherein a respective cam is formed on the eccentric shafts, which cam cooperates with the clamping limb.

Instead of the second freely projecting end in the contrary direction to the busbar, which has an opening for inserting a tool, a spring element which is particularly suitable for cooperating with the actuating element can have a second and third freely projecting bent end on the clamping limb. In this case, the second and third freely projecting bent end serve as a mounting aid for the actuating element for actuating the spring element.

A housing half shell which is particularly suitable for cooperating with the actuating element can suitably have, on its two lateral walls, a respective detent for interlocking latching to a latching contour provided in the first and second bearing portion of the connecting contact and an aperture which corresponds to a bearing contour provided in the first and second bearing portion. In this case, the apertures corresponding to the bearing contours are formed to interlock with the eccentric shafts of the actuating element and provide a bearing contour for the actuating element.

The actuating element of this embodiment of the invention is arranged with its lever and its brackets outside the housing half shell, whilst its eccentric shafts are supported in the bearing contour provided by means of the housing half shell and the first and second limb. In this case, the two brackets are arranged adjacent to the lateral walls of the housing half shell in each case. By means of an actuation of the actuating element, the cams formed on the eccentric shafts cooperate with the clamping limb of the spring element in such a way that the spring element can be brought into the first, second and in particular third tension state in each case. By means of the actuating element, the connection device can be advantageously operated without the aid of a tool.

The housing half shell of the above-described embodiment of the invention likewise has an inner contour interlocking with the first and second bearing portion of the connecting contact and the spring element and/or the bearing pins and an insertion aid for inserting the conductor into the connection device.

An above-described connection device according to an embodiment of the invention can be suitably provided in particular to provide an electrical contact between at least one electrical conductor and a busbar of an electrical connecting contact for an insert of a plug connector having an insulating body. In this case, the electrical connecting contact suitably extends with its busbar and a contact element in the mating direction of the plug connector to provide an electrical contact with a corresponding contact element of a mating plug connector.

An electrical connecting contact of an above connection device which is suitable for a plug connector can particularly advantageously be a grounding element for a contact connection of at least one protective conductor, wherein a protective conductor connection is provided by means of the connection device. In each case, two or more mutually independently actuable spring elements of the above-described embodiment, arranged next to one another and having corresponding individual openings for inserting a tool, can be suitably provided accordingly for connecting two or more protective conductors. In this case, a corresponding suitable housing half shell can have an inner contour as described above and suitable apertures.

The busbar of an above grounding element can advantageously be formed as a central mounting region of the grounding element on a wall of the insulating body, whereby the busbar has a particularly advantageous dual function. For a conductor equipped with a plastic sleeve, a suitable aperture for receiving the plastic sleeve can be formed in the mounting region.

The contact element of the grounding element can be suitably formed as a contact pin, which extends on a wall of a connection region of the insulating body in the mating direction for connection to a mating plug connector.

A suitable spring element is suitably made from spring steel. A suitable actuating element and a suitable housing half shell can each be provided from a suitable plastic and, for an above grounding element, likewise from metal.

BRIEF DESCRIPTION OF THE DRAWINGS

Exemplary embodiments of the invention are illustrated in the drawings and will be explained in more detail below. In the drawings.

The figures contain partially simplified, schematic illustrations. Identical reference signs are sometimes used for elements which are similar but possibly not identical. Different views of similar elements may be drawn to different scales.

DETAILED DESCRIPTION OF THE INVENTION

Figure 1A:
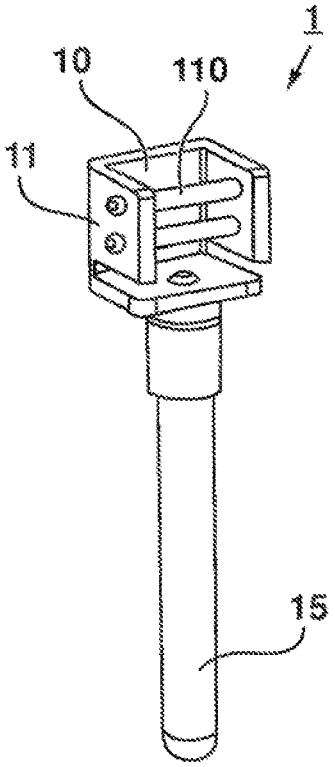
FIG. 1A shows an electrical connecting contact equipped with bearing pins, which is suitable for a connecting device according to an embodiment of the invention.

FIG. 1A shows an electrical connecting contact 1, which is equipped with a first and second bearing pin 110 and is suitable for a connection device according to an embodiment of the invention. The connecting contact 1 is provided for an insert of an electrical plug connector and has an elongated contact element 15, which extends in the mating direction S and is connected to a busbar 10 for establishing contact with an electrical conductor 5. A first and second mutually opposing limb 11 are angled on the busbar 10. A first and second bearing portion 11 for a spring element 2 (described below with reference to FIG. 1C) are provided by means of the first and second limb. The first and second bearing pin 110 are arranged above one another on the first and second bearing portion 11, perpendicularly to the mating direction S. A bearing device for the spring element 2 is provided by means of the bearing portions 11 and the bearing pins 110.

Figure 1B:
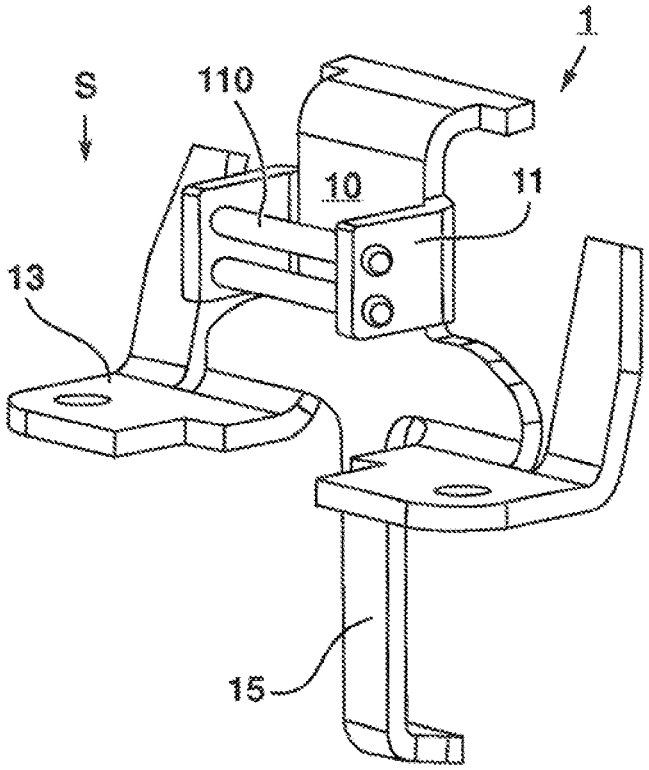
FIG. 1B shows an electrical connecting contact formed as a grounding element and equipped with bearing pins, which is suitable for a connection device according to an embodiment of the invention.

FIG. 1B shows an electrical connecting contact 1, which is equipped with a first and second bearing pin 110 and is suitable for a connection device according to an embodiment of the invention. The connecting contact 1 is provided as a grounding element 1 for an insert of an electrical plug connector. A mounting region 10 of the grounding element 1 is provided for mounting on a wall 60 of an insulating body of the insert for the plug connector. A contact element 15 extending in the mating direction S to provide an electrical contact with a mating plug connector is formed on the mounting region 10 of the grounding element 1. A busbar 10 for establishing contact with an electrical conductor 5 is moreover provided by means of the mounting region 10 of the grounding element 1.

A first and second mutually opposing limb 11 are angled on the busbar 10. A first and second bearing portion 11 for a spring element 2 (described below with reference to FIG. 1C) are provided by means of the first and second limb. The first and second bearing pin 110 are arranged above one another, perpendicularly to the mating direction S. A bearing device for the spring element 2 is provided by means of the bearing portions 11 and the bearing pins 110.

The grounding element 1 moreover has a third and fourth limb 13 angled perpendicularly to the mating direction. A contact surface for electrical contacting of a conductive plug connector housing and moreover a flange 13 for mounting the grounding element 1 on a supporting surface 63 provided on the wall 60 are provided by means of the third and fourth limb 13. In this connection, please refer to the description below with reference to FIG. 7.

Figure 1C:
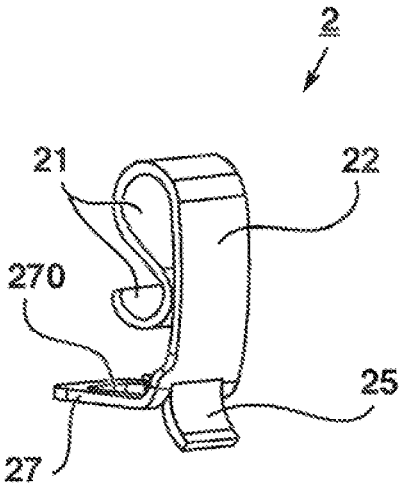
FIG. 1C shows a spring element according to an embodiment of the invention, which is suitable for the connecting contact and the grounding element.

FIG. 1C shows a spring element 2 according to an embodiment of the invention, which is formed in an S-shape and is suitable for the connecting contact 1 and the grounding element 1. The S-shaped spring element 2 has a first and second bearing portion 21 bent in opposite directions. The bearing portions 21 are provided for arrangement on the bearing pins 110 and, in this case, at least partially embrace the bearing pins 110. An elongated clamping limb 22 adjoins the second bearing portion 21, which clamping limb extends such that it protrudes downwards beyond the first bearing portion 21 in the drawing. It should be mentioned here that the spring element 2 is shown in the third tension state described at the outset, in which the clamping limb 22 is arranged adjacent to the first and second bearing portion 21.

The S-shaped spring element 2 has an advantageously long spring travel with its first and second bearing portion 21 and its elongated clamping limb 22 such that a spring element 2 having desirable predetermined spring properties for an embodiment of an inventive connection device is provided.

A first freely projecting end 25, which is bent in a first direction, is provided on the clamping limb 22. A second freely projecting end 27 is moreover bent in a second direction on the clamping limb 22. An opening 270 for inserting a tool 7 for actuating the spring element 2 is formed in the second freely projecting end 27.

Figure 1D:
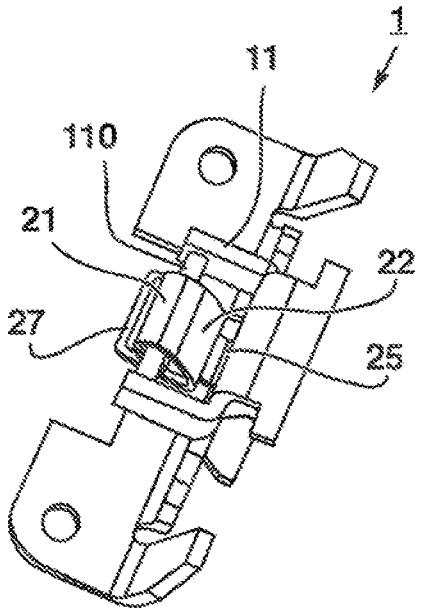
FIG. 1D shows a connection device according to an embodiment of the invention with the spring element of FIG. 1C arranged on the grounding element of FIG. 1B

FIG. 1D shows a connection device according to an embodiment of the invention with the spring element 2 of FIG. 1C, which is arranged on the grounding element 1 of FIG. 1B, from above.

The bends of the first and second bearing portion 21 of the spring element 2 at least partially embrace the first and second bearing pin 110 in each case, which bearing pins are arranged above one another on the first and second bearing portion 11 angled on the busbar 10. In this case, the lower bearing pin 110 is arranged in the bend of the first bearing portion 21 of the spring element 2, wherein the first bearing portion 21 is bent in the contrary direction to the busbar 10. The upper bearing pin 110 is arranged in the bend of the second bearing portion 21 adjoining the first bearing portion 21 of the spring element 2, wherein the second bearing portion 21 is bent in the direction of the busbar 10.

In this case, the clamping limb 22 adjoining the second bearing portion 21 extends downwards between the first and second bearing portion 21 and the busbar 10 and abuts with it first freely projecting contact end 25 against the busbar 10. The second freely projecting end 27 extends below the first bearing portion 21 in the contrary direction to the busbar 10, wherein the opening 270 for inserting a tool 7 for actuating the spring element 2 is accessible. In this case, the spring element 2 is located in the first tension state described at the outset, in which the contact end 25 abuts against the busbar 10 under a predetermined pre-tension of the spring element 2.

The embodiment of the connection device of FIG. 1D is suitable for connecting a protective conductor 5 to the grounding element 1.

Figure 2A:
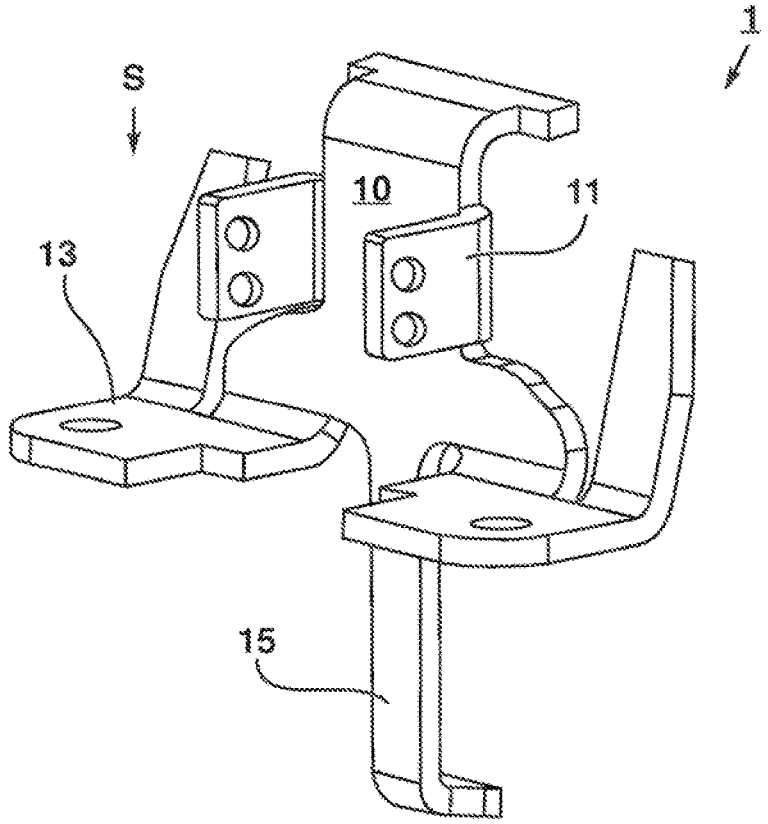
FIG. 2A shows the grounding element of FIG. 1B without the bearing pins.
Figure 2B:
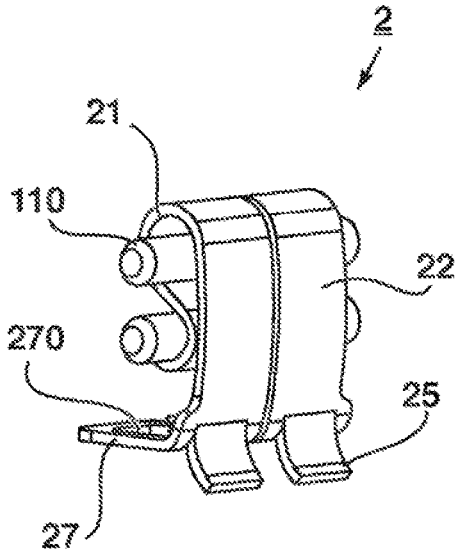
FIG. 2B shows two spring elements of FIG. 1C, which are arranged on the bearing pins.

FIG. 2A shows the grounding element 1 of FIG. 1B without the bearing pins 110 and FIG. 2B shows two spring elements 2, which are arranged next to one another on the bearing pins 110 and correspond to the spring element 2 of FIG. 1C in each case. The two opposing limbs 11 are angled on the busbar 10 of the grounding element 1, which limbs form opposing bearing portions 11 with their apertures for receiving the bearing pins 110.

FIG. 2B shows two spring elements of FIG. 1C arranged next to one another on the bearing pins 110. The spring elements 2 are arranged as intended on the bearing pins 110, wherein the respective bearing portions 21 of the spring elements 2 at least partially embrace one of the bearing pins 110 arranged above one another by means of their oppositely directed bends.

In the drawing, the spring elements 2 are shown in the third tension state of the spring element 2 described at the outset, in which the elongated clamping limb 22 adjoining the upper bent bearing portion 21 is arranged adjacent to the bearing portions 21. The first freely projecting contact end 25 and the second freely projecting end 27 with its opening 270 each correspond to the spring element 2 of FIG. 1B, so please refer to the relevant description here.

Figure 2C:
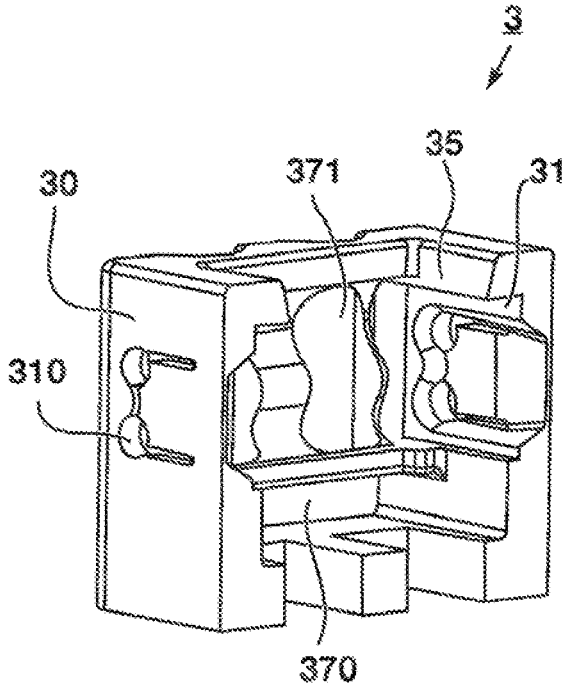
FIG. 2C shows a housing half shell for the grounding element.

FIG. 2C shows a housing half shell 3 for the grounding element 1 and the spring elements 2 of FIG. 2B. The housing half shell 3 has an inner contour which corresponds in an interlocking manner to the contour of the spring elements 2, the opposing bearing portions 11 and the bearing pins 101. In this case, respective apertures 31 and 310 are formed in the opposing lateral walls 30 of the housing half shell 3 to receive the bearing portions 11 and the bearing pins 110.

The housing half shell 3 moreover has through-apertures 370 and 371, which are each provided for the second freely-projecting ends 27 with their openings 270 and the bearing portions 21 of the spring elements 2, whereby the openings 270 are accessible from outside the housing half shell 3 for inserting a tool 7 for individual actuation of the spring elements 2. The edge of an upper opening of the housing half shell 3 has a chamfer 35 and provides an insertion aid 35 for inserting an electrical conductor 5.

Figure 3A:
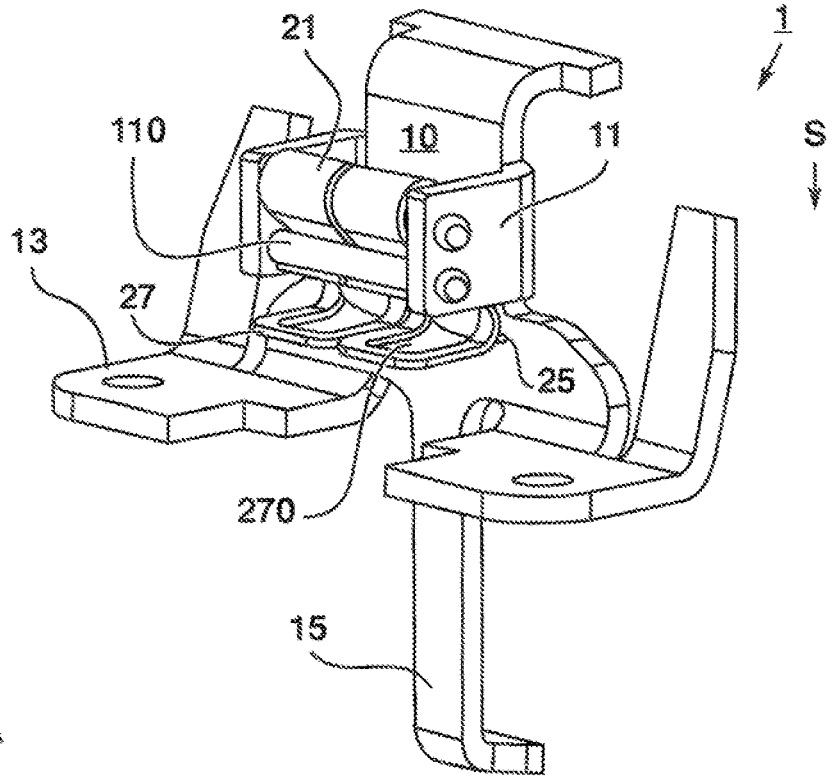
FIG. 3A shows a connection device according to an embodiment of the invention with the grounding element and the spring elements.

FIG. 3A shows a connection device according to an embodiment of the invention with the grounding element 1 of FIG. 2A and the two spring elements 2 of FIG. 2B, which are arranged as intended with the bearing pins 110 on the opposing bearing portions 11 of the grounding element 1 which are angled on the busbar 10. In this case, the spring elements 2 are located in the first pre-tensioned tension state described at the outset, wherein the freely projecting first contact ends 25 of the spring elements 2 abut against the busbar 10. Two protective conductors 5 can be advantageously connected to the grounding element 1 by means of this embodiment of the connection device.

The first bent bearing portions 21 of the spring elements 2 partially embrace the lower bearing pin 110 with their bends, wherein the bends are in the opposite direction to the busbar 10. The second bent bearing portions 21 of the spring elements 2 embrace the upper bearing pin 110 with their bends and, in this case, are bent in the direction towards the busbar 10.

Figure 3B:
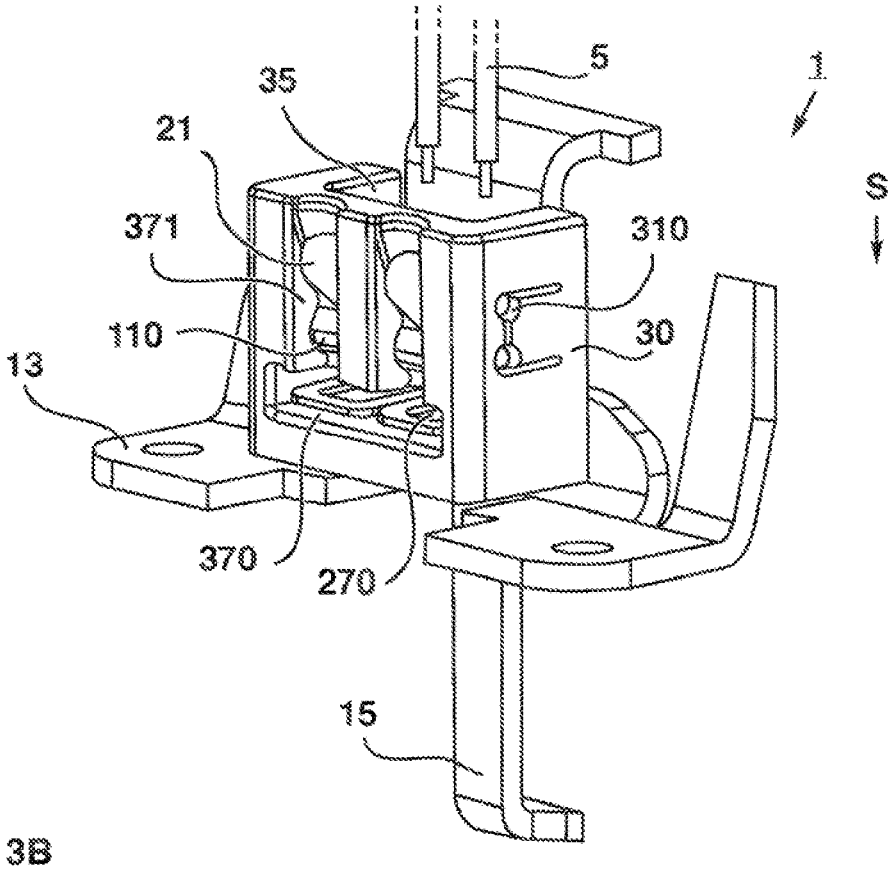
FIG. 3B shows the connection device equipped with the housing half shell of FIG. 2C.

FIG. 3B shows the connection device of FIG. 3A, which is equipped as intended with the housing half shell 3 of FIG. 2C, together with two electrical conductors 5. Via the aperture 370, the second freely projecting ends 27 of the spring elements 2 are accessible with their openings 270 from outside for inserting a tool 7 for individual actuation of the spring elements 2. The bearing portions 21 of the spring elements 2 are likewise accessible from outside via the apertures 371.

The housing half shell 3 is latched to the ends of the bearing pins 110 by its apertures 310 and thus fixed on the grounding element 1 in a stationary manner. In this case, the housing half shell 3 accommodates the clamping limb 22 and the first freely projecting contact end 25 and an electrical conductor 5 (not illustrated in the drawing), which is inserted as intended via the upper opening and insertion aid 35 of the housing half shell 3 and is clamped against the busbar 10 by means of the contact end 25 of the spring element 2. A contact connection of the electrical conductor 5 to the grounding element 1 is thus provided and the electrical conductor 5 is fixed on the busbar 10 of the grounding element 1.

The connection device having the two mutually independently actuable spring elements 2 arranged next to one another is suitably formed for the connection of two conductors 5. It is clear that a connection device provided for a plurality of conductors 5 can have a corresponding number of individually actuable spring elements 2 arranged next to one another. In this case, such a connection device can also have a correspondingly suitably modified housing half shell 4.

Figure 4A:
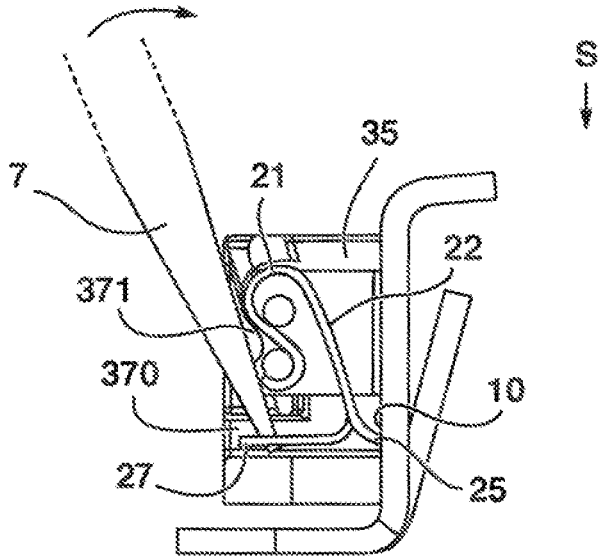
FIG. 4A shows a longitudinal section through a detail of the connection device of FIG. 3B with a spring element in a first tension state.
Figure 4B:
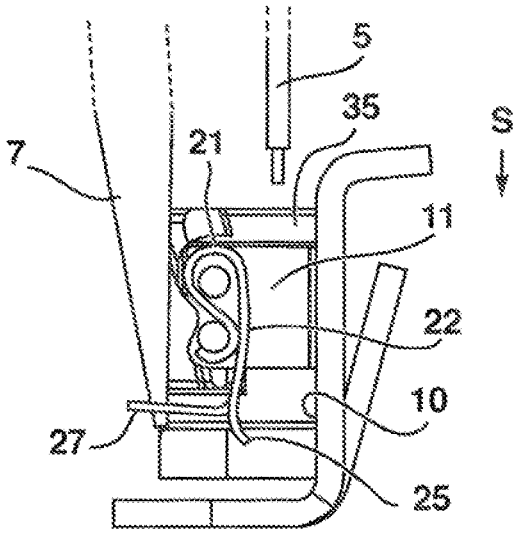
FIG. 4B shows the connection device with the spring element in a third tension state.

FIG. 4A shows a longitudinal section through a detail of the connection device of FIG. 3B with the spring element 2 in the first tension state and FIG. 4B shows the connection device with the spring element 2 in a third tension state.

The S-shaped spring element 2 has an advantageously long spring travel, whereby the spring element 2 has desirable spring properties which enables reliable and simple connection of multiple electrical conductors 5 having different conductor cross-sections and material properties, wherein the spring element 2 is also configured for connecting electrical conductors 5 equipped with cable end sleeves. The connection device of this embodiment of the invention is suitable for conductors having a conductor cross-section of 0.15 $mm^2$ to 4 $mm^2$.

In this case, the above spring properties of the spring element 2 enable tool-free connection of an electrical conductor 5 which has a predetermined stability. In this case, a suitable conductor 5 for this is inserted into the connection device in the mating direction S via the upper opening and insertion aid 35 of the housing half shell 3 and clamped by the first freely projecting contact end 25 and the busbar 10. In this state, the spring element 2 is located in a second tension state described at the outset. In this case, the spring properties of the spring element 2 are advantageously configured in such a way that a spring force acting on the conductor 5 likewise increases with the increasing conductor cross-section in the second tension state.

In this case, the contact end 25 bent in the direction towards the busbar 10 from the elongated clamping limb 22 extending between the busbar 10 and the bearing portions 21 provides an advantageous locking contour, which effectively prevents the conductor 5 from being inadvertently pulled out contrary to the mating direction S.

By inserting a tool 7 into the opening 270 of the second freely projecting end 27, which is accessible via the aperture 370, a lever can be applied to the edge of the opening 270, wherein a bearing portion 21 of the spring element, which is likewise accessible via a through-aperture 371, serves as a first pivot point of the lever. By pivoting the tool 7, the spring element 2 can be easily actuated and transferred from its first and/or second tension state to its third tension state, wherein an edge of the housing half shell 3 can also serve as a pivot point of the lever in the course of the pivotal movement.

The connection device with the spring element 2 in its third tension state is illustrated in FIG. 4B, wherein the elongated clamping limb 22 is arranged adjacent to the first and second bearing portion 21 and the freely projecting contact end 25 is spaced from the busbar 10. In the third tension state of the spring element 2, a conductor 5 can be inserted into the connection device to provide an electrical connection contact to the busbar 10 or removed from the connection device.

In the third tension state of the spring element 2, conductors 5 without the above-mentioned adequate stability properties can also be easily inserted into the connection device. The spring element can then be transferred to its second tension state by actuating the tool 7, whereby the conductor 5 is fixed on the busbar 10 by means of the contact end 25 of the spring element 2. Of course, the spring element 2 can also be brought from the third tension state to the first tension state in the same way.

Figure 5A:
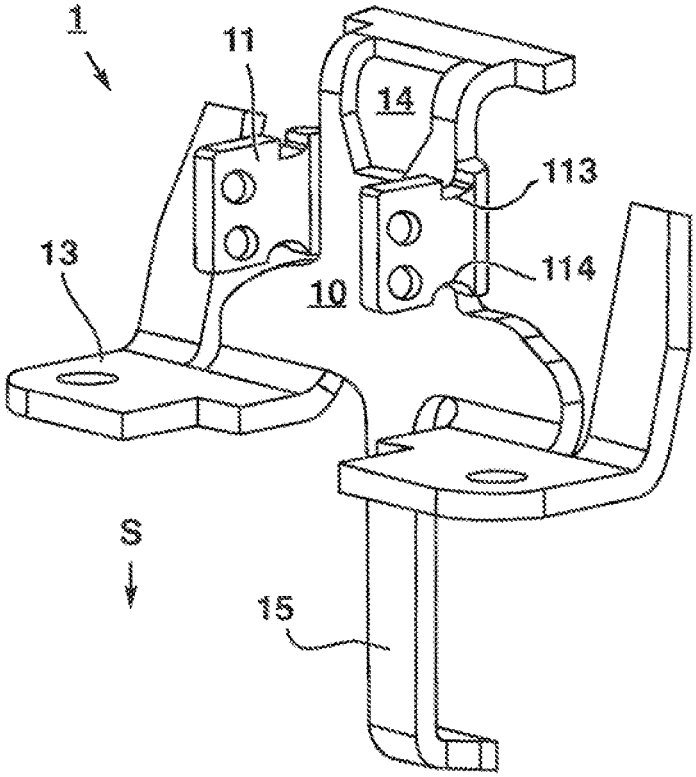
FIG. 5A shows an electrical connecting contact formed as a grounding element, which is suitable for a connection device according to an embodiment of the invention.

FIG. 5A shows an electrical connecting contact 1 which is formed as a grounding element 1 and is suitable for a connection device according to an embodiment of the invention. The grounding element 1 corresponds substantially to the grounding element 1 of FIGS. 1B and 2A, so please refer to the relevant description here.

In contrast to the embodiment of the grounding element 1 of FIGS. 1B and 2A, an upper aperture 113 formed as a latching contour and a lower aperture 114 formed as a bearing contour are formed on the opposing first and second angled bearing portion 11 in each case. The mounting region 10 of the grounding element 1, by means of which the busbar 10 is also provided, moreover has an aperture 14 for accommodating a plastic sleeve of a conductor 5 equipped with a corresponding plastic sleeve.

Figure 5B:
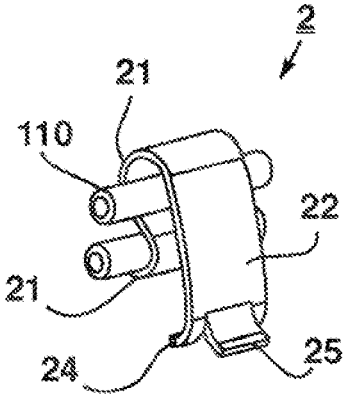
FIG. 5B shows a spring element according to an embodiment of the invention, which is provided for the grounding element of FIG. 5A and arranged on bearing pins.

FIG. 5B shows a spring element 2 according to an embodiment of the invention, which is provided for the grounding element of FIG. 5A and arranged on bearing pins 110. The S-shaped spring element 2 has an advantageously long spring travel and corresponds substantially to a spring element 2 of FIGS. 1C and 2B, so please refer to the relevant description here.

Unlike the spring elements 2 of FIGS. 1C and 2B, the spring element 2 is shown in its first tension state, in which the elongated clamping limb 22 is spaced from the first and second bearing portion 21. Instead of the second freely projecting end 27, a second and third comparatively short freely projecting end 24 are bent in the contrary direction to the first freely projecting contact end 25 on the clamping limb 22 of the spring element 2. An insertion aid for mounting an actuating element 4 is provided by means of the second and third freely projecting end 24.

Figure 5C:
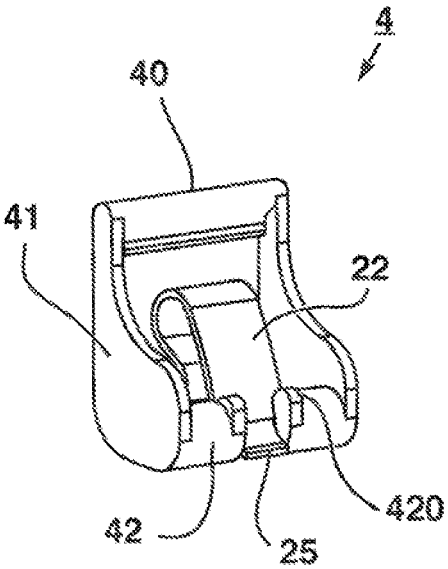
FIG. 5C shows an actuating element which is suitable for the spring element of FIG. 5B together with the spring element.

FIG. 5C shows an actuating element 4 of FIG. 5B, which is suitable for the spring element 2 and provided for actuating the spring element 2, together with the spring element 2 in its first tension state. An opposing first and second bracket 41 are provided on a lever arm 40 of the actuating element 4, on which brackets a first and second eccentric shaft 42 are formed in each case.

By means of the actuating element 4, a means for an advantageously tool-free actuation of the spring element 2 is provided, by means of which the spring element 2 can be brought into the first, second and third tension state. Upon the actuation of the actuating element 4, the eccentric shafts 42 serve as a pivot point for the lever arm 40. A respective cam 420 is provided on the eccentric shafts 42 and is rotated with respect to the clamping limb 22 of the spring element 2 upon a pivotal movement of the lever arm 40. The freely projecting contact end 25 of the spring element 2 is arranged between the two eccentric shafts 42.

Figure 5D:
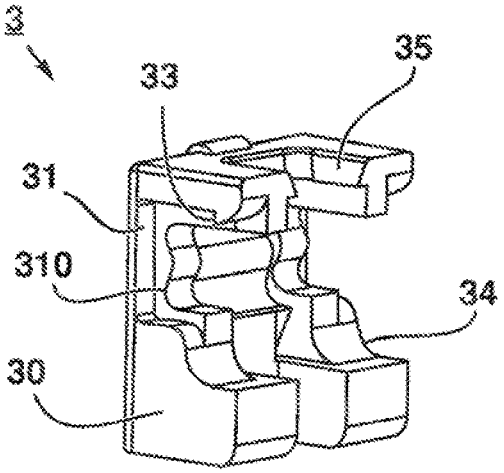
FIG. 5D shows a housing half shell which is suitable for the grounding element of FIG. 5A, the spring element and the actuating element.

FIG. 5D shows a housing half shell 3 which is suitable for the grounding element 1 of FIG. 5A, the spring element 2 and the actuating element 4 of FIG. 5C and has an inner contour which corresponds in an interlocking manner to the grounding element 1, the spring element 2, the bearing pins 110 and the actuating element 4.

In this case, the inner contour of the housing half shell 3 has, in particular, an aperture 31 formed on its lateral walls 30 for receiving the first and second bearing portion 11, a detent 33 for latching to the latching contours 113 formed in the bearing portions 11 and a respective aperture 34, which apertures correspond to the apertures 114 formed in the bearing portions 11. Further apertures 310 correspond to the bearing pins 110.

The housing half shell 3, like the housing half shell 3 of the embodiment of FIG. 2C, likewise has an upper opening with a chamfer 35 by means of which an insertion aid for inserting an electrical conductor 5 is provided.

Figure 6A:
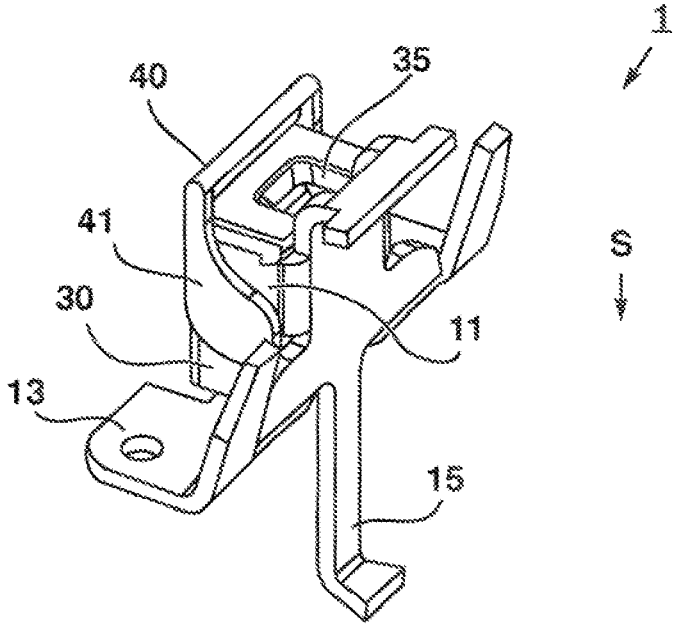
FIG. 6A shows a connection device according to an embodiment of the invention with the grounding element of FIG. 5A, the housing half shell, the actuating lever and the spring element.

FIG. 6A shows a connection device according to an embodiment of the invention with the grounding element 1 of FIG. 5A, the actuating element 4 and the spring element 2 of FIG. 5C and the housing half shell 3 of FIG. 5D. The detents 33 of the housing half shell 3 are latched to the latching contours 113 and the actuating element 4 is arranged with its brackets 41 adjacent to the lateral walls 30 of the housing half shell 3 and to the bearing portions 11.

In this case, the apertures 114 formed in the bearing portions 11 correspond to the apertures 34 of the housing half shell 3 in such a way that a bearing contour for supporting the eccentric shafts 42 of the actuating element 4 is provided. In this case, the eccentric shafts 42 arranged in the housing half shell 3 are inserted in their intended positions via the insertion aid 24 provided on the spring element 2. A stop for the lever arm 40 which is pivotally arranged in this manner is provided by means of the flange 13 provided on the grounding element 1.

Figure 6B:
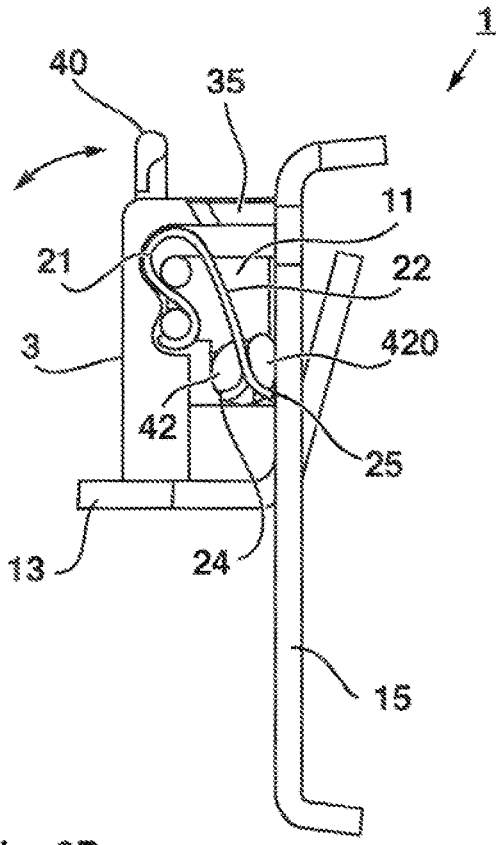
FIG. 6B shows a longitudinal section through the connection device of FIG. 6A with the spring element in a first tension state.
Figure 6C:
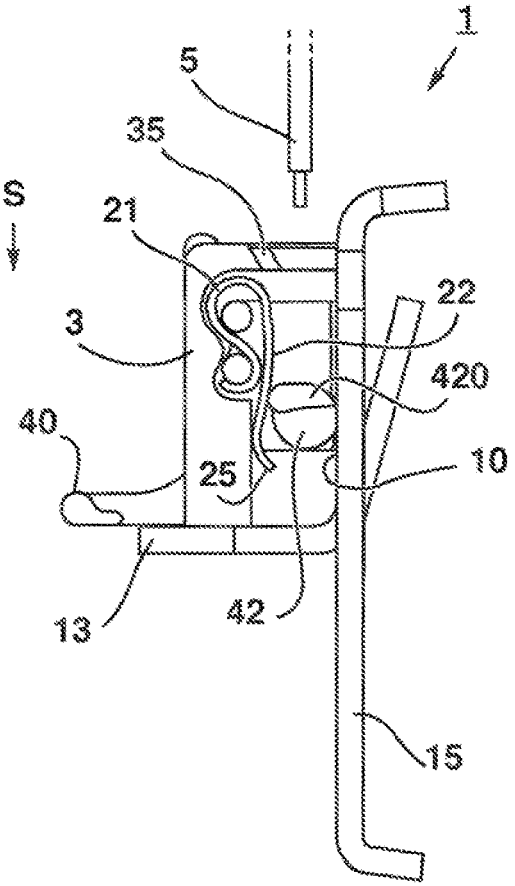
FIG. 6C shows the connection device with the spring element in a third tension state.

FIG. 6B shows a longitudinal section through the connection device of FIG. 6A with the spring element 2 in the first tension state and FIG. 6C shows the connection device with the spring element 2 in a third tension state. The spring element 2 has the same advantageous spring properties as the spring element 2 of the embodiment of FIGS. 4A and 4B, so please refer to the relevant description with regard to the first, second and third tension state of the spring element 2 and the advantageous cooperation of the contact end 25 with multiple different conductors 5.

In the first and second tension state of the spring element 2, the lever arm 40 of the actuating element 4 and the cams 420 formed on the eccentric shafts 42 are each in a first position, in which the clamping limb 22 faces a narrow side of the cams 420 and the freely projecting contact end 25 extends beyond the eccentric shaft 42 in the direction of the busbar 10.

In the third tension state of the spring element 2 of FIG. 6C, the lever 40 is pivoted into a second position, in which the cams 420 cooperate with the clamping limb 22 of the spring element 2 in such a way that the clamping limb 22 is arranged adjacent to the first and second bearing portion 21 and the contact end 25 is spaced from the busbar 10. An unlocking lever for the connection device is provided by means of the actuating element 4.

Figure 7:
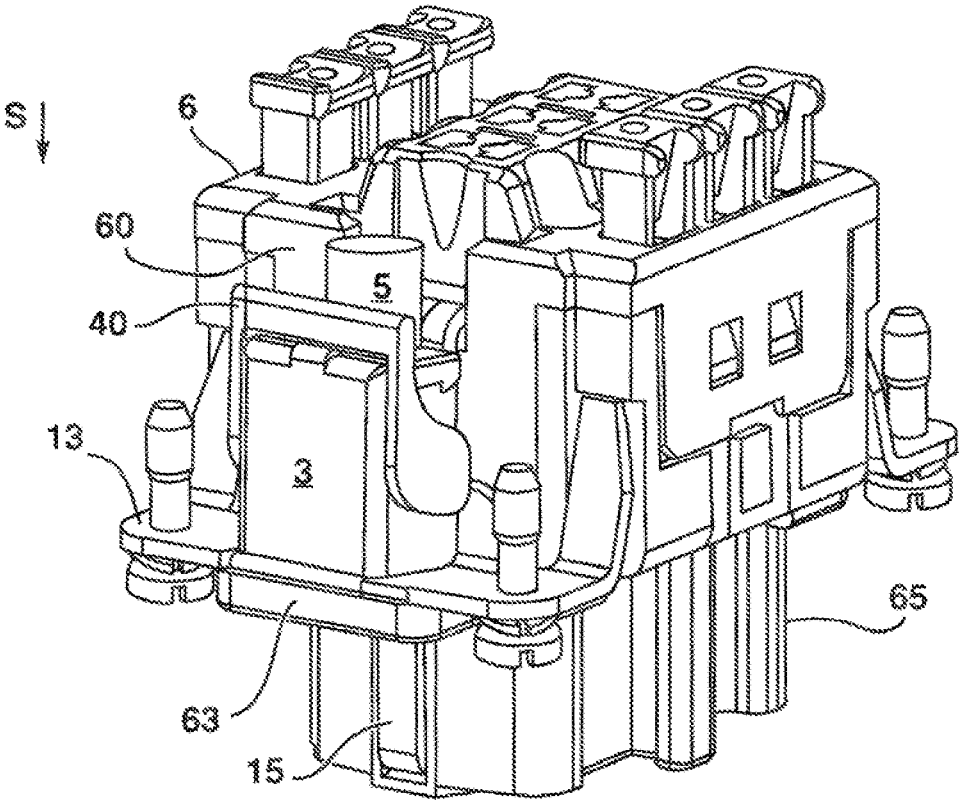
FIG. 7 shows the connection device of FIG. 6A, which is mounted as intended on an insulating body of a plug connector and equipped with a protective conductor and the housing half shell.

FIG. 7 shows the connection device of FIG. 6A mounted as intended on an insulating body 60 of a plug connector and equipped with a protective conductor 3 and the housing half shell 4. The lever arm 40 of the actuating element 4 is in the first position and the spring element 2 is in a second tension state, in which the protective conductor 5 is fixed on the busbar.

The grounding element 1 extending in the mating direction S abuts in an interlocking manner against the wall 60 of the insulating body 6 by means of its mounting region 10 and its contact element 15 formed as a contact pin which is angled at its end.

The contact element 15 is arranged on the connection region 65 of the insulating body 6 to provide an electrical contact with a mating plug connector. A flange provided by means of the third and fourth limb 13 has a contact surface equipped with two screws and rests on a protrusion 63 of the insulating body, which is formed on the wall 60, to provide an electrical contact with a plug connector housing (not illustrated) for mounting to the plug connector housing by means of the screws.

The embodiments of a connection device which are described above with reference to the drawings have a particularly advantageous compact spatial form both in the mating direction S and perpendicularly to the mating direction S, yet are still suitable for connecting multiple different conductors.

Even where combinations of different aspects or features of the invention are shown in the figures in each case, it is clear to a person skilled in the art—unless indicated otherwise—that the combinations shown and discussed are not the only possible combinations. In particular, mutually corresponding units or feature complexes from different exemplary embodiments can be interchanged with one another.

Connection Device for Electrical Conductors

LIST OF REFERENCE SIGNS

1 Connecting contact, grounding element
10 Busbar, mounting region
11 First, second limb; bearing portion
110 Bearing pin
113 Aperture, latching contour
114 Aperture, bearing contour
13 Third, fourth limb; contact surface, flange
14 Aperture
15 Contact element, contact pin
2 Spring element, S-shaped spring, S-spring
21 First, second bearing portion, bend
22 Clamping limb
24 Freely projecting end, insertion aid
25 Freely projecting end, contact end, locking contour
27 Freely projecting end, edge
270 Unlocking aperture
3 Housing half shell
30 Wall
31 Aperture
310 Aperture
33 Detent
34 Aperture, bearing contour
35 Chamfer, insertion aid
370, 371 Aperture
4 Actuating element, unlocking lever
40 Lever arm
41 Bracket
42 Eccentric shaft
420 Cam
5 Electrical conductor, protective conductor
6 Insulating body
60 Wall
63 Protrusion, supporting surface
65 Connection region
7 Tool
S Mating direction

The invention claimed is:

1. A connection device configured to provide an electrical contact between at least one electrical conductor and a busbar of an electrical connecting contact, said connection device comprising a bearing device including at least one spring element formed on the busbar of the connecting contact;

wherein the spring element is formed and arranged in an actuable manner on the bearing device in such a way that the spring element can be brought from a first tension state to a second and third tension state; wherein, in the first tension state of the spring element, a contact end of the spring element abuts against the busbar and, in the second tension state of the spring element, the conductor is fixed on the busbar by the contact end of the spring element whereby to close a contact connection of the conductor to the busbar and, in the third tension state of the spring element, the contact connection for the conductor to the busbar is opened, wherein the spring element is a meander-shaped or S-shaped spring having a first and second bend;

a first and second bearing portion of the spring element are formed by the first and second bend;

an elongated clamping limb adjoins the second bearing portion, on which clamping limb the contact end is formed as a first freely projecting end for the contact connection of the conductor to the busbar and for fixing the conductor on the busbar;

the freely projecting contact end is bent in a direction of the busbar on the clamping limb such that a locking contour for the conductor is provided, and wherein a second freely projecting end having an opening for insertion of a tool is formed on the clamping limb in a contrary direction to the busbar as the device for actuating the spring element.

2. The connection device as claimed in claim 1, wherein the spring element is formed and arranged on the bearing device in such a way that the spring element has a predetermined spring constant and a predetermined spring travel, in that the contact connection is suitable for multiple conductors having different conductor cross-sections; and the spring element can be brought from the first tension state to the second tension state by a conductor having predetermined properties by inserting the conductor into the connection device; wherein a device for actuating the spring element is provided, which device is formed and arranged in such a way that the spring element can be brought from the first tension state to the second tension state; and/or a device for actuating the spring element is provided, which device is formed and arranged in such a way that the spring element can be brought from the first and/or second tension state to the third tension state; and/or a device for actuating the spring element is provided, which device is formed and arranged in such a way that the spring element can be brought from the third tension state to the first and/or second tension state.

3. The connection device as claimed in claim 1, wherein:

a first and second opposing limb are angled on the busbar;

a first and second bearing portion are provided on the busbar of the connecting contact y the first and second limb;

a first and second bearing pin are provided on the first and second bearing portion;

the bearing device for the spring element is formed on the connecting contact by the first and second bearing portion and the first and second bearing pin; wherein the first and second bearing pin are arranged in the bend of the first and second bearing portion of the spring element in each case.

4. The connection device as claimed in claim 1, having a housing half shell for accommodating the spring element, wherein the housing half shell has an inner contour, which interlocks with the first and second limb and/or the connecting contact and/or the bearing pins and/or the spring element and/or the actuating element, and an insertion aid for inserting the conductor.

5. The connection device as claimed in claim 1, wherein the connection device has two spring elements arranged next to one another.

6. The connection device as claimed in claim 1, having the features:

the connecting contact is provided for an insert of a plug connector having an insulating body and extends with its busbar and a contact element in the mating direction of the plug connector to provide an electrical contact with a mating plug connector.

7. The connection device as claimed in claim 6, wherein the connecting contact is a grounding element, and the conductor is a protective conductor, and a protective conductor connection is provided by means of the connection device.

8. The connection device as claimed in claim 7, wherein a central mounting region of the grounding element is configured to contact a wall of the insulating body via the busbar.

9. A connection device configured to provide an electrical contact between at least one electrical conductor and a busbar of an electrical connecting contact, said connection device comprising a bearing device including at least one spring element formed on the busbar of the connecting contact;

wherein the spring element is formed and arranged in an actuable manner on the bearing device in such a way that the spring element can be brought from a first tension state to a second and third tension state; wherein, in the first tension state of the spring element, a contact end of the spring element abuts against the busbar and, in the second tension state of the spring element, the conductor is fixed on the busbar by the contact end of the spring element whereby to close a contact connection of the conductor to the busbar and, in the third tension state of spring element, the contact connection for the conductor to the busbar is opened, wherein the spring element is a meander-shaped or S-shaped spring having a first and second bend;

a first and second bearing portion of the spring element are formed by the first and second bend;

an elongated clamping limb adjoins the second bearing portion, on which clamping limb the contact end is formed as a first freely projecting end configured for the contact connection of the conductor to the busbar and for fixing the conductor on the busbar;

the freely projecting contact end is bent in a direction of the busbar on the clamping limb such that a locking contour for the conductor is provided, and wherein a second and third freely projecting end are formed on the clamping limb in a contrary direction to the busbar as a mounting aid for an actuating element for actuating the spring element.

10. The connection device as claimed in claim 9, having the features:

the actuating element is an unlocking lever having a lever arm, two brackets arranged opposite one another and two eccentric shafts, wherein a respective cam is formed on the eccentric shafts, the unlocking lever is formed and arranged on the electrical connecting contact in such a way that, by actuating the unlocking lever, the cams cooperate with the clamping limb in such a way that the spring element is brought from the first and/or second tension state to the third tension state and from the third tension state to the first and/or second tension state.

11. The connection device as claimed in claim 9, having the features:

the spring element is a meander-shaped or S-shaped spring having a first and second bend;

a first and second bearing portion of the spring element are formed by the first and second bend;

an elongated clamping limb adjoins the second bearing portion, on which clamping limb the contact end is formed as a first freely projecting end for the contact connection of the conductor to the busbar and for fixing the conductor on the busbar;

the freely projecting contact end is bent in a direction of the busbar on the clamping limb such that a locking contour for the conductor is provided.

12. The connection device as claimed in claim 11, wherein a second freely projecting end having an opening for insertion of a tool is formed on the clamping limb in a contrary direction to the busbar as the device for actuating the spring element.

13. The connection device as claimed in claim 9, wherein:

a first and second opposing limb are angled on the busbar;

a first and second bearing are provided on the busbar of the connecting contact by the first and second limb;

a first and second bearing pin are provided on the first and second bearing portion;

the bearing device for the spring element is formed on the connecting contact by the first and second bearing portion and the first and second bearing pin; wherein the first and second bearing pin are arranged in the bend of the first and second bearing portion of the spring element in each case.

14. A spring element for a connection device for providing an electrical contact between an electrical conductor and a busbar of an electrical connecting contact, wherein the spring element has a meander-shaped or S-shaped spring having a first and second bend formed in opposite directions; and, by the first and second bend, a first and second bearing portion of the spring element for supporting the spring element is formed on a bearing device provided on the connection device; and an elongated clamping limb adjoins the second bearing portion, on which clamping limb a contact end is formed as a first freely projecting end for a contact connection of the conductor to the busbar and for fixing the conductor on the busbar.

15. The spring element as claimed in claim 14, wherein the bearing device has a first and second opposing limb angled on the busbar of the connecting contact, wherein a first and second bearing portion are formed on the connecting contact by the first and second limb; wherein a first and second bearing pin for the first and second bearing portion of the spring element are provided on the first and second bearing portion; wherein the first and second bearing portion of the spring element at least partially embrace the first and second bearing pin in opposite directions in each case; and wherein the clamping limb extends between the first and second bearing portion and the busbar, and the contact end faces the busbar.

16. The spring element as claimed in claim 14, for an electrical connection device, wherein the electrical connection device includes a bearing device for at least one spring element formed on the busbar of the connecting contact; wherein the spring element is formed and arranged in an actuable manner on the bearing device such that the spring element can be brought from a first tension state to a second and third tension state; wherein, in the first tension state of the spring element, a contact end of the spring element abuts against the busbar and, in the second tension state of the spring element, the conductor is fixed on the busbar by the contact end of the spring element and a contact connection for the conductor to the busbar and, in the third tension state of the spring element, the contact connection for the conductor to the busbar is opened.

* * * * *